United States Patent [19]

Klewsaat

[11] Patent Number: 4,888,119

[45] Date of Patent: Dec. 19, 1989

[54] CATIONIC/ANIONIC SURFACTANT COMPLEX ANTISTATIC AND FABRIC SOFTENING EMULSION FOR WASH CYCLE LAUNDRY APPLICATIONS

[75] Inventor: Dean G. Klewsaat, Watchung, N.J.

[73] Assignee: Colgate-Palmolive Co., Piscataway, N.J.

[21] Appl. No.: 916,067

[22] Filed: Oct. 6, 1986

[51] Int. Cl.[4] ..... D06M 13/32; D06M 13/46; C11D 1/86; C11D 17/08

[52] U.S. Cl. ..... 252/8.75; 252/8.7; 252/8.8; 252/8.9; 252/173; 252/174.21; 252/174.22; 252/174.25; 252/528; 252/547

[58] Field of Search ..... 252/8.8, 8.6, 174.21, 252/174.25, 528, 547, 8.75

[56] References Cited

U.S. PATENT DOCUMENTS

| | | | |
|---|---|---|---|
| 4,000,077 | 12/1976 | Wixon | 252/542 |
| 4,264,457 | 4/1981 | Beeks et al. | 252/8.75 |
| 4,411,803 | 10/1983 | Wixon | 252/8.75 |

FOREIGN PATENT DOCUMENTS 818419 7/1969 Canada .

*Primary Examiner*—Paul Lieberman
*Assistant Examiner*—John F. McNally
*Attorney, Agent, or Firm*—Bernard Lieberman; Murray M. Grill; Robert C. Sullivan

[57] ABSTRACT

An emulsion of cationic/anionic surfactant complex is provided, for addition to the wash water in the wash cycle operation of automatic washing machines, to make washed and dried laundry softer to the touch and static-free. Major advantages of the invention are that the cationic/anionic surfactant complex, in emulsion form, is stable during storage, as is the emulsion, and the complex does not deposit on the laundry as greasy stains, such as are obtained when a sufficient antistatic and fabric softening proportion of cationic surfactant is added to a control wash water containing a detersive proportion of synthetic anionic detergent.

Also within the invention are processes for manufacturing the described emulsion and for employing it with synthetic anionic detergent in washing laundry and simultaneously treating it to make it softer and static-free.

7 Claims, No Drawings

CATIONIC/ANIONIC SURFACTANT COMPLEX ANTISTATIC AND FABRIC SOFTENING EMULSION FOR WASH CYCLE LAUNDRY APPLICATIONS

This invention relates to emulsions of cationic/anionic surfactant complexes, which are useful for addition to wash waters of automatic washing machines to make washed laundry antistatic or static-free and softer to the touch. More particularly, the invention relates to aqueous emulsions in which the proportions of anionic surfactant and cationic surfactant in the mentioned complexes are within a certain relatively narrow range, and in which the proportions of such complex, emulsifying agent and aqueous medium are in prescribed ranges.

Various cationic surfactant (surface active) compounds have long been known and have long been employed as fabric softeners and antistatic agents for washed laundry. Because it was known that such compounds reacted adversely with anionic materials in wash waters, such as detergents, for many years such cationic surfactants were incorporated only in preparations intended for addition to the rinse water. That necessitated a special trip to the laundry room by the person doing the laundry, to add the antistatic softener to the rinse water. Because much laundry washing today is done by automatic washing machine, and such machines are not normally equipped with audible signals indicating the beginning of the rinse cycle, often the washing and rinsing would be completed and the addition of the cationic surfactant to the rinse water would have been unintentionally omitted. Thus, it was considered highly desirable to be able to have a means or preparation for adding cationic surfactant, such as quaternary ammonium salt or imidazolinium salt, in the wash cycle, together with the detergent composition. However, such addition resulted in the reaction by ionic bonding, of the cationic surfactant with various materials in the wash water, such as with anionic detergent to produce a waxy water insoluble reaction product, with anionic fluorescent brighteners and with color anions from the tap water, which reaction products could then deposit on the laundry. Due to such ionic bonding reactions detergency would be decreased, as would be fluorescent brightening of the laundry, and greasy deposits of the reaction product on the laundry could appear colored (usually yellowed).

Despite the disadvantages of the use of cationic fabric softening and antistatic surfactants in the wash cycle in conjunction with anionic detergents, anionic detergent compositions have been made which contained such cationic surfactants. Such products require the employment of additional anionic detergent and fluorescent brightener (to make up for such compounds which reacted with the cationic surfactant) and deposits of greasy reaction product on the laundry would still occur. However, in the present invention, wherein such anionic/cationic surfactant complexes are intentionally made and are then emulsified and added to the wash cycle wash water as such emulsion, the cationic/anionic surfactant complex, being already formed, does not further react with anionic detergent, fluorescent brightener or anionic color bodies or other anionic materials in the wash water, the emulsified complex does not additionally agglomerate or expand, and yet the finely divided complex, in emulsion (or fine dispersion) form, effectively deposits on the laundry to soften it and effectively diminish "static cling", of laundered items, which is often observed when the laundry washed is made in whole or in part of synthetic polymeric materials, and is subjected to automatic tumble drying after washing and rinsing.

In accordance with the present invention a fabric softening and antistatic aqueous emulsion of a complex of a cationic surfactant and an anionic surfactant is made, in which complex the molar proportions of cationic and anionic moieties are in the range of about 1:1 to 1:1.5, which comprises about ten parts by weight of such complex, 0.5 to 10 parts of emulsifying agent and 15 to 100 parts of aqueous medium. In preferred embodiments of the invention the anionic surfactant is an anionic detergent of the sulfonate, sulfate or carboxylate type, which includes a lipophilic moiety, or is a mixture of such detergents, the cationic surfactant is a quaternary ammonium salt or an imidazolinium salt, or mixture thereof, the emulsifying agent is an ethoxylated higher alkyl amine, an ethoxylated higher alcohol or an ethoxylated higher alkyl amine/higher fatty acid complex, or a mixture thereof, the aqueous medium is water, and the emulsion is an oil-in-water microemulsion. Also within the invention are processes for manufacturing such emulsions and for employing them as fabric softeners and antistats in the wash cycle of an automatic washing machine in an operation in which the detergent employed is a built synthetic anionic organic detergent.

Searches of available prior art and of other records have resulted in the findings of U.S. Pat. No. 4,000,077 (hereby incorporated by reference) and an article in Fette, Seifen und Anstrichmittel, Volume 74, No. 9, pages 527–533 (1972). U.S. Pat. No. 4,000,077 discloses a textile softening composition which contains as essential components a cationic quaternary softener, such as an imidazolinium salt, and a minor amount of a higher aliphatic alcohol sulfate. This patent discloses various imidazolinium salts and higher aliphatic alcohol sulfates, together with procedures for reacting them. The patent teaches that the described softening compositions could be made in liquid or particulate form, adsorbed onto a carrier, but employment thereof was only in the rinse water. The Fette, Seifen und Anstrichmittel reference describes a process for making a fabric softening compound by a condensation reaction of beta-hydroxyethyl ethylenediamine and fatty acids or their alkyl esters. It is evident that neither of these publications anticipates the present invention or makes it obvious.

Applications of the inventor's co-workers, James M. Thomas and Ronald D. Kern, entitled respectively, Permeable Pouch Article Containing Fabric Softening and Antistatic Cationic and Anionic Surfactants or Complex Thereof, and Fabric Softening and Antistatic Particulate Wash Cycle Laundry Additive Containing Cationic/Anionic Complex on Bentonite, and filed on the same day as the present application, are considered to be of interest, and therefore are mentioned herein. The former Ser. No. 916,069 (Thomas and Kern), relates to a fabric softening and antistatic article comprising anionic and cationic surfactants, or a complex thereof, in a filtering pouch, intended for addition to the wash water, and the latter, Ser. No. 916,068 (Kern) is for a fabric softening anti-static agent which is a complex similar to those of the present invention, deposited on bentonite powder, which also functions as a fabric softening agent.

The cationic surfactant employed may be any suitable cationic surfactant which has either fabric softening or antistatic properties. Primarily, those cationic materials which are most useful are what will be referred to as quaternary ammonium salts, which are those wherein at least one higher molecular weight group and two or three lower molecular weight groups are linked to a common nitrogen atom to produce a cation and wherein the electrically balancing anion is a halide, acetate or lower alkosulfate ion, such as chloride or methosulfate. The higher molecular weight substituent on the nitrogen is preferably a higher alkyl group, containing 12 to 18 or 20 carbon atoms, such as coco-alkyl, tallowalkyl, hydrogenated tallowalkyl or substituted higher alkyl and the lower molecular weight substituents are preferably lower alkyl of 1 to 4 carbon atoms, such as methyl or ethyl, or substituted lower alkyl. One or more of said lower molecular weight substituents may include an aryl moiety or may be replaced by an aryl, such as benzyl, phenyl or other suitable substituent. A preferred quaternary ammonium salt is a di-higher alkyl, di-lower alkyl ammonium halide, such as di-tallowalkyl dimethyl ammonium chloride or di-hydrogenated tallowalkyl dimethyl ammonium chloride, and other quaternary ammonium chlorides will also usually be preferred.

In addition to the cationic compounds previously mentioned, other suitable cationic surfactants include the imidazolinium salts, such as 2-heptadecyl-1-methyl-1-[(2-stearoylamido) ethyl]-imidazolinium chloride; the corresponding methyl sulfate compound; 2-methyl-1(2-hydroxyethyl)-1-benzyl imidazolinium chloride; 2-coco-1-(2-hydroxyethyl)-1-benzyl imidazolinium chloride; 2-coco-1-(2-hydroxyethyl)-1-octadecenyl imidazolinium chloride; 2-heptadecenyl-1-(2-hydroxyethyl)-1-(4-chlorobutyl) imidazolinium chloride; and 2-heptadecyl-1(hydroxyethyl)-1octadecyl imidazolinium ethyl sulfate. Generally, the imidazolinium salts of preference will be halides (preferably chlorides) and lower alkylsulfates (alkosulfates).

Others of the mentioned quaternary ammonium salts and imidazolinium salts having fabric softening and/or antistatic properties may also be employed in the present invention and various others of such compounds are described in U.S. Pat. No. 4,000,077.

The anionic surfactants which may be employed to form complexes employed in the manufacture of the emulsions of this invention may be any suitable anionic surface active agents, including those utilized for their detersive, wetting or emulsifying powers, but normally these will preferably be anionic detergents. Such detergents will normally include a lipophilic anionic moiety of relatively high molecular weight, which lipophile will preferably be or include a long chain alkyl or alkenyl group of at least 12 carbon atoms, such as of 12 to 18 carbon atoms. Such lipophilic moiety will usually include a sulfonic, sulfuric or carboxylic group so that when neutralized there will be produced a sulfonate, sulfate or carboxylate, with the cation preferably being an alkali metal, ammonium or alkanolamine, such as triethanolamine. The higher alkyls of such surfactants may be from 10 to 20 carbon atoms but normally will be of 12 to 18 carbon atoms, and in the present invention will preferably be of 12 to 16 carbon atoms. Examples of the anionic surfactants include sodium dodecylbenzene sulfonate, sodium linear tridecylbenzene sulfonate, potassium octadecylbenzene sulfonate, sodium lauryl sulfate, triethanolamine lauryl sulfate, sodium palmityl sulfate, sodium cocoalkyl sulfate, sodium tallowalkyl sulfate, sodium ethoxylated higher fatty alcohol sulfate of 1 to 30 ethylene oxide groups per mole, such as sodium monoethoxy octadecanol sulfate and sodium decaethoxy cocoalkyl sulfate, sodium paraffin sulfonate, sodium olefin sulfonate (of 10 to 20 carbon atoms in the olefin), sodium cocomonoglyceride sulfate, and sodium cocotallow soap (1:4 coco:tallow ratio). Preferred anionic detergents for complexing with the cationic surfactants are the higher alkylbenzene sulfonates, the higher fatty alcohol sulfates, and the ethoxylated higher fatty alcohol sulfates, in which the salt forming cation is preferably alkali metal, more preferably sodium.

The emulsifying agent employed may be any suitable emulsifier, capable of emulsifying the cationic/anionic surfactants complex to produce a stable emulsion (or dispersion), which will not settle out on storage, and in which the complex will not be adversely affected, which emulsion will very preferably be a microemulsion. Although various emulsifying agents may be employed, those which are preferred are surface active, and of these the more preferred are the ethoxylated higher alkyl amines, the ethoxylated higher alcohols, and the ethoxylated higher alkyl amine/higher fatty acid complexes. Of course, mixtures of any or all of these emulsifiers may be employed, and in the previous descriptions of the surfactants, mixtures of any or all of the named materials may also be employed. The ethoxylated higher amines will normally be of 12 to 18 carbon atoms in the alkyls thereof and of 5 to 50 moles of ethylene oxide per mole, preferably being monotallowalkyl amines of 5 to 40 moles of ethylene oxide per mole. Examples of such amines are those sold as or as Ethomeens®, or as TAM-8, TAM-15, TAM-20 and TAM-40, by Emery Industries, which are ethoxylated higher alkyl amines, specifically tallowalkyl amines of about 8, 15, 20 or 40 moles of ethylene oxide per mole. Complexes of higher fatty acids, such as stearic acid, with tallow ethoxylated amines are also useful emulsifiers. These are made by heating equimolar proportions of the ethoxylated amines, such as TAM-8, TAM-15, TAM-20 or TAM-40, or a mixture thereof, and higher fatty acid, such as stearic acid, until the components melt and the mix becomes clear, after which it is allowed to cool. Although the ethoxylated higher alkyl amines (and stearic acid complexes thereof) are preferred emulsifying agents for the purpose of this invention, and help to impart additional fabric softening and antistatic properties to the emulsion, ethoxylated higher alcohols are also preferred emulsifiers, especially in mixture with ethoxylated higher alkyl amine emulsifiers. The ethoxylated higher alcohols are preferably polyethoxylated higher fatty alcohols wherein the alcohol is of 12 to 18 carbon atoms and which include 3 to 20 moles of ethylene oxide per mole of alcohol. Among such materials the preferred emulsifier is that sold as Neodol® 25-7, which numerical code indicates that the higher fatty alcohol average is within the range of 12 to 15 carbon atoms and that about seven moles of ethylene oxide are present in the condensation product per mole of fatty alcohol.

The aqueous medium is preferably deionized water but it may contain solvents, dissolved salts, hydrotropes and various adjuvants, such as fluorescent brighteners, bluing agents and perfumes. Among the solvents which may be employed are ethanol and propylene glycol, usually in minor proportions (less than 50% with respect to the total aqueous medium). Normally, however, it is preferred to employ only water. Tap water is usually acceptable but deionized water is more preferred.

In the normal employment of the invented emulsions they are added to the wash water in an automatic washing machine. In such wash water there is normally employed a built synthetic anionic organic detergent composition, which is usually initially in spray dried particulate form or is liquid. Such products contain synthetic anionic detergent and builder for such detergent and may contain filler salts. The synthetic anionic detergent will be of one or more of the types listed in the previous description of the anionic surfactant detergents employed to make the cationic/anionic complex, with the three mentioned types being preferred (alkylbenzene sulfonate, higher fatty alcohol sulfate and ethoxylated higher fatty alcohol sulfate). The builders in the built detergent compositions may include organic and inorganic materials and may be water soluble or water insoluble. Preferably, the builders are inorganic and are selected from the group consisting of polyphosphates, carbonates, bicarbonates, borates, silicates, zeolites, and mixtures thereof, with sodium tripolyphosphate, sodium pyrophosphate, sodium carbonate, sodium bicarbonate, sodium silicate, sodium borate, and mixtures thereof being more preferred. Among the fillers that may be employed are alkali metal sulfates and chlorides, especially the sodium salts thereof, and of these, sodium sulfate is much preferred. Although the most significant advantages of the invention are obtained when the emulsions thereof are charged to wash waters which include anionic detergent, the invented emulsions also may be used with nonionic detergent compositions, such as Fresh Start and All.

The aqueous emulsions of this invention are oil-in-water emulsions and very preferably are microemulsions, in which the dispersed phase is of micron size, usually being less than 5 microns in diameter and preferably being of sizes in the range of 0.01 to 1 micron. The employment of the specific types of emulsifiers mentioned in this specification is helpful in obtaining the described microemulsions, as is the maintenance of vigorous agitation (stirring) during the cooling of the emulsion from elevated temperature to room temperature. In the manufacture of the emulsion the emulsifier(s) and the agitation will be chosen and regulated, respectively, to obtain the desired microemulsions.

To obtain the desired emulsions it has been found that it is useful to employ a cationic/anionic surfactant complex in which the proportions of cationic and anionic moieties are in the range of about 1:1 to 1:1.5. It is undesirable to have an excess of cationic surfactant in such complex because such excess will be available to react with anions in the wash water. However, although the range of 1:1 to 1:1.5 for the cationic/anionic surfactants ratio of proportions is the desirable range, an excess of anionic surfactant may be employed in the complex, even to a ratio of cationic:anionic surfactants of 1:5, since such will add cleaning power to the wash water and may help in emulsifying the complex. Nevertheless, only a relatively small excess of anionic moiety, up to a ratio of 1:1.5, is contemplated as desirable, and often, a 1:1 ratio is that considered ideal, because such is the ratio for the actual cationic/anionic complex, with complete reaction of the surfactants of both such types.

The emulsion made comprises about 10 parts by weight of the mentioned complex (and preferably, even if an excess of anionic detergent is employed, the ten parts are of the proportion of complex within the 1:1 to 1:1.5 cationic/anionic surfactant range), 0.5 to 10 parts of emulsifying agent and 15 to 100 parts of aqueous medium. Preferably, with ten parts by weight of the complex, the proportion of emulsifying agent will be 1 to 5 parts and the proportion of aqueous medium will be 15 to 50 parts. More preferably, such ratios will be 1.1 to 4.4 parts and 20 to 35 parts, respectively. In certain preferred emulsions, which are described in the following working examples, and wherein ethoxylated higher fatty alcohol and ethoxylated mono-tallowalkyl amine emulsifiers are employed together, the proportions of such emulsifiers will preferably be in the range of 1:1 to 5:1, with the compositions containing ten parts of complex, 3 to 4 parts of emulsifiers (total) and 30 to 35 parts of water. In other preferred emulsions the weight ratio of ethoxylated higher fatty alcohol emulsifier to ethoxylated monotallowalkyl amine emulsifier is in the range of 1:1 to 2:1 and the emulsion comprises ten parts of complex, 3 to 5 parts of such emulsifiers (total) and 20 to 25 parts of water.

The manufacture of the described complexes may be effected by mixing together the selected cationic and anionic surfactants in the specified molar proportions and heating them, with stirring, to a sufficiently high temperature, e.g., 160° C., to drive off any solvents or water which may be present so that the mix becomes translucent. In a preferred modification of this procedure the cationic surfactant may be heated to an elevated temperature at which it melts, e.g., 70° C., and while heating and stirring of the liquid cationic surfactant is continued, the anionic surfactant may be slowly added to it, after which the temperature may be increased to drive off the water and any solvent present, and to clarify the melt. Next, the hot complex is preferably transferred to another container in such a manner that any insoluble material (often sodium chloride byproduct) is left behind, and the decanted, purified complex is allowed to cool and solidify.

After manufacture and purification of the complex in the manner described above, the invented emulsion may be made by heating a mixture of the complex and emulsifier (or mixture of emulsifiers) to an elevated temperature, e.g., 90° C., at which the mix is in liquid state, with stirring, after which, while continuing stirring and maintaining the elevated temperature, aqueous medium (preferably deionized water) is added slowly (often preferably dropwise) to the hot liquid mixture of complex and emulsifier, until the mixture passes through its inversion point, after which the addition of the aqueous medium is continued, with stirring, until the desired formulation is obtained. Then, the resulting formulation is allowed to cool to room temperature, while being appropriately stirred, preferably vigorously, to maintain it in oil-in-water microemulsion form.

Although the temperatures to which the components of the complex are heated and to which the components of the emulsion are heated during manufacture depend to some extent on the materials being employed, it is usually found that the temperature to which the cationic surfactant will be heated to melt it will be in the range of 50° to 90° C., preferably 60° to 80° C., e.g., about 65° or 70° C., the temperature to which the cationic and anionic surfactants are desirably heated to form the complex will be in the range of 105° to 200° C., preferably 140° to 180° C., e.g., about 160° C., and the temperature at which the emulsion is made will be in the range of 60° to 95° C. or preferably 75° to 95° C., e.g., 85° or 90° C.

The invented emulsions are normally employed in wash water containing a built synthetic organic anionic detergent composition, and are useful to soften laundry and render it free of "static cling". In such a process the built synthetic organic anionic detergent composition, either in particulate, liquid or other suitable form, is first added to the wash water, preferably in an automatic washing machine, after which the desired proportion of the invented emulsion is added to the wash water. The wash water temperature will normally be in the range of 30° to 95° C., preferably 30° to 60° C. or 35° to 50° C., e.g., about 40° or 50° C. The concentration of the built detergent composition will normally be in the range of 0.05 to 0.5%, preferably being 0.1 to 0.3% and more preferably being 0.1 to 0.2%. The amount of emulsion employed will usually be in the range of 10 to 100% (1:10 to 1:1 ratio) of the detergent composition, by weight, with a preferred range of such percentages being 25 to 50%, e.g., about 30 or 40%. Thus, from 0.02 to 0.2% (on the basis of the wash water) of emulsion will be employed when 0.05 to 0.5% of detergent composition is used, and when the preferred 0.1 to 0.3% of detergent composition is present, 0.03 to 0.1% of emulsion will be employed with it.

When the fabric softening and antistatic emulsion of this invention is added as a wash cycle additive to wash water containing built synthetic organic anionic detergent composition, noticeable improvement in fabric softening and freedom from static cling of the washed and tumble dried laundry results. Such improvement occurs without loss of cleaning power and without loss of fluorescent brightening effect (if a fluorescent brightener is present in the detergent composition or in the emulsion), and the laundry is not spotted with greasy deposits of complex that are apparent to the naked eye. Neither is it discolored, as by color anions from the wash water During the washing operation the complex, in micron sized globules, deposits on the materials being washed and is held to them. Because the deposits are of very small units the finished laundry does not appear to be grease-spotted, as would be the result when larger deposits, globules or smears of such complex are applied to the laundry. The deposits of complex remain on the laundry even after removal of some or all of the emulsifier during washing and rinsing operations. The result is that the finished laundry is softened and after rinsing and drying, when it would be expected that synthetics, such as polyesters, nylons, acetates, acrylics, and synthetic/cotton blends would accumulate static charges, especially when the laundry is dried in an automatic tumbled dryer, the laundry is static-free and does not cling to the wearer, when worn.

Although the emulsions of this invention are primarily intended for addition to the wash water, and for use together with a built synthetic organic anionic detergent composition, they may also be employed as rinse water additives or in separate treatments of laundry or textiles to soften such items and render them static-free.

It is considered that the emulsions of this invention are superior to various other forms of the described cationic/anionic surfactant complexes in producing good softening and static control, while at the same time avoiding grease spotting of the laundry, and other disadvantages associated with the complexes. In part, at least, it is thought that such superiority relates to the controllable finely divided globules or particles of complex that are deposited on the laundry. It is considered that deposition from the present microemulsions is superior to deposition from solutions or melts of complex in the wash water, which could coalesce to form greasy deposits on the laundry. In the present emulsions the complex globules or particles do not coalesce, even at elevated wash water temperatures, and in fact it appears that the usual elevated temperature of the wash water may help to maintain them in a dispersed liquid or near-liquid state, in which they are readily deposited on the laundry, with which they may form further complexes.

The following examples illustrate but do not limit this invention. Unless otherwise indicated, all parts in such examples, in this specification and in the claims, together with all percentages by weight and all temperatures, are in °C.

EXAMPLE 1

Manufacture of Cationic/Anionic Complex

A molar proportion of di-hydrogenated tallowalkyl dimethyl ammonium chloride (about 572 g./mole) and a molar proportion of sodium tridecylbenzene sulfonate (about 362 g./mole) are reacted to form a cationic/anionic complex of this invention. First, the quaternary ammonium salt described is heated to a temperature of about 65° C., at which it melts. Subsequently, while continuing to heat the quaternary salt melt, the mentioned anionic surfactant is slowly added to it, with stirring. The heat is then increased (stepwise) to 160° C. and during such heating any water and solvent which may be present are driven off. The hot complex resulting is carefully transferred to another container by decantation, so that the precipitate of sodium chloride byproduct is retained in the first container. The purified complex made is then allowed to cool to room temperature.

In a modification of this process instead of employing pure cationic and anionic surfactants, commercial sources of them are utilized, Arquad® 2HT-75, and sodium linear tridecylbenzene sulfonate in slurry form, which is normally employed for the manufacture of commercial spray dried built synthetic organic anionic detergent compositions. The Arquad 2HT-75 is 75% active and the anionic surfactant slurry is 48% active so there are employed 1.01 parts by weight of the Arquad 2HT-75 for every part by weight of the sodium linear tridecylbenzene sulfonate slurry (one part of the quaternary ammonium chloride per 0.63 part of the sodium linear tridecylbenzene sulfonate). Using the commercial materials, rather than those which are 100% active, results in a longer heating time to the 160° C. temperature, due to driving off more water (from the anionic surfactant slurry) and solvent (from the Arquad 2HT-75), and more precipitate is obtained from the reaction, but after decantation the complexes produced are essentially equivalent.

In a manner like those described above other complexes are made by employing molar proportions (on an active ingredient [A.I.]basis) of sodium monoethoxy dodecyl sulfate, sodium lauryl sulfate, and sodium cocate (sodium soap of coco fatty acids). Furthermore, additional complexes are made by utilizing the mentioned anionic surfactants and reacting them separately, in equimolar proportions, with lauryl trimethyl ammonium bromide, fatty amido alkyl ammonium chloride (Culversoft® WS), methyl alkyl amido ethyl alkyl imidazolinium methosulfate (Varisoft® 475) and dimethyl dicocoalkyl ammonium chloride (Andogen® 462). Substantially the same manufacturing process is employed and the complexes that are obtained are suitable for incorporation into wash cycle fabric softening and antistatic emulsions according to this invention. All the complexes are solids at room temperatures and are waxy, greasy, or oily in appearance, whether they are pure complexes or mixtures of complexes.

EXAMPLE 2

Manufacture of Cationic/Anionic Complex Emulsions

The complex of dihydrogenated tallowalkyl dimethyl ammonium chloride and sodium tridecylbenzene sulfonate of Example 1 is made into five different emulsions, employing mono-tallow ethoxylated amine emulsifiers and higher fatty alcohol polyethoxylate emulsifier, in different mixtures. The formulations of the emulsions are given in Table 1, below.

TABLE 1

| | Parts by weight | | | | |
|---|---|---|---|---|---|
| Component | A | B | C | D | E |
| Complex | 100 | 100 | 100 | 100 | 100 |
| *TAM-15 | 10 | — | — | — | 6 |
| **TAM-20 | 10 | 12 | 6 | 9 | 9 |
| ***TAM-40 | — | 4 | — | — | — |
| ****Neodol 25-7 (Shell Chemical Co.) | 20 | 24 | 27 | 21 | 15 |
| Deionized Water | 235 | 235 | 314 | 320 | 320 |
| | 375 | 375 | 447 | 450 | 450 |

*Ethoxylated mono-tallowalkyl amine (15 EtO)
**Ethoxylated mono-tallowalkyl amine (20 EtO)
***Ethoxylated mono-tallowalkyl amine (40 EtO)
****Condensation product of one mole of higher fatty alcohol averaging 12 to 15 carbon atoms, with about seven moles of ethylene oxide To manufacture the emulsions of the described cationic/anionic complex the formula weights of complex and emulsifiers (the other components except for the water) are weighed out, placed in a suitable heating vessel, and heated to a temperature of about 85° C., at which the mixtures are liquid. That temperature is maintained by continuing heating, while stirring, and water is slowly added (preferably dropwise when small amounts of emulsion are being made), with stirring, until the mixture passes through its inversion point. Addition of water is continued, with heating and stirring until all has been added. Then, the emulsion formed is allowed to cool to room temperature, while being stirred vigorously, to maintain the microemulsion. The product resulting is a stable, non-settling emulsion, which is a useful fabric softening and antistatic wash cycle additive for treating laundry in automatic washing machines.

Instead of ethoxylated higher alkylamides of Formulas A-E, one may employ higher fatty acid complexes of them, which may be made by reacting equimolar proportions of the amine(s) with the higher fatty acid, e.g., stearic acid, at elevated temperature, with heating and stirring, and then cooling to room temperature.

In modifications of the experiments of this example other emulsifiers may also be employed, including TAM-8 (in replacement of TAM-15 in Example 2-A), Neodols 25-3, 23-7 and 45-11, glyceryl monostearate, isopropyl myristate, myristate, ethoxylated dodecyl phenol, polyoxyethylene 40 monostearate, coco fatty acid alkanolamide, polyethylene glycol 200 dilaurate, and polyoxyethylene sorbitol stearate, and any suitable mixture of such emulsifiers. Also, instead of the desirable mixtures illustrated in Formulas A-E of Example 2, the various pure emulsifiers may be employed, such as Neodol 25-7 in replacement of the TAM-20 in Example 2-C. Similarly, the different complexes mentioned in Example 1 may be substituted for that of Formulations A-E. In some cases the presences of water soluble salts may aid emulsification, and sometimes it may also be considered desirable to employ adjuvants, such as colorants, perfumes and fluorescent brighteners.

While the processings of the emulsion formula variations mentioned herein may be altered somewhat so as better to suit the process to the particular materials being used, essentially the same operations are carried out as were previously described in this example. The different products resulting are also stable and effective wash cycle fabric softening and antistatic emulsions.

EXAMPLE 3 (Washings of Fabrics, and Comparative Test Results)

Emulsions A-E of Example 2 were employed in comparative tests of their efficacies as fabric softening and anti-static wash cycle additives, utilizing automatic washing machines with low hardness wash waters at a temperature of about 39° C., which "warm" water washing is considered to be a severe, yet practical test of detergent compositions. The amounts of particulate detergents and wash water employed were 85 grams and 64 liters, respectively, for a full size, top loading, home laundry automatic washer. If desired, liquid detergents can be employed instead of the particulate products. The amounts of cationic/anionic complex emulsion are indicated in Table 2, together with test data obtained. In the washings there is utilized tap water which is of a mixed calcium and magnesium hardness of about 100 parts per million (p.p.m.). The detergent employed is a commercial built synthetic organic anionic detergent composition containing approximately 4% of sodium linear dodecylbenzene sulfonate, 12% of sodium higher (12 to 15 carbon atoms) fatty alcohol ethoxylate (1 to 3 ethoxy groups per mole), 35% of sodium tripolyphosphate, 5% of sodium silicate, 25% of sodium sulfate, 5% of water, and the balance of various functional adjuvants. This product is sold commercially as TIDE®. The wash load included five each of swatches of cotton percale, 65% Dacron®/35% cotton, Dacron double knit, Dacron single knit, Banlon® nylon, acetate jersey and nylon tricot, all of which swatches measured 36×38 cm. The synthetic and synthetic blend swatches of such wash load are useful for evaluating static accumulations after tumble drying in an automatic laundry dryer. Also present in the washing machine were four cotton wash cloths (of terrycloth), useful for evaluating softening effects, and Soil Removal Index swatches of several different textile materials, stained with different "difficult" stain materials, including three swatches each of: Testfabrics nylon and cotton materials, each stained with an oily soil/particulate stain; clay on cotton; clay on 65% Dacron®/35% cotton blend; and EMPA 101 (oily soil/particulate stain). The wash water is added first to the wash tub of the machine, followed by detergent and cationic/anionic complex emulsion and such materials are mixed in the wash tub for about a minute, using wash cycle agitation, after which the wash load swatches, the cotton wash cloths and the Soil Removal Index (SRI) swatches are added and a ten minute regular wash cycle is begun. Washing is followed by conventional automatic rinsing and after completion of the rinsing and extracting cycles the various test materials and wash load materials are transferred to an automatic laundry dryer, in which they are dried for an hour. The test results are given in Table 2 below.

TABLE 2

| | A | B | C | D | E | F (TIDE) | G (Commercial Built Detergent With Incorporated Fabric Softener-Antistat) |
|---|---|---|---|---|---|---|---|
| Weight of Complex Emulsion Charged (grams) | 30 | 30 | 44.7 | 45 | 45 | 0 | 0 |
| Fabric softness (1–10 scale, increasing as softness increases) | 8.9 | 9.4 | 8.6 | 8.2 | 9.1 | 4.9 (av.) | 7.6 (av.) |
| Static (1–9 scale increasing as static charge and cling increase) | 1.5 | 1.0 | 1.2 | 1.3 | 1.2 | 8.9 (av.) | 2.0 (av.) |
| Soil Removal Index total (higher numbers indicate better cleaning) | 259.5 | 259.9 | 242.2 | 247.6 | 242.7 | 258.3 (av.) | 233.3 (av.) |

*av. = average of two runs

The data clearly establish that the employment of the emulsions of the present invention, together with a commercial built synthetic organic anionic detergent composition, in the wash cycle of automatic washing machine washing of laundry, significantly increases fabric softness and decreases static charges thereon after washing and drying of the laundry, without significantly adversely affecting the soil removal power of the detergent. In similar experiments, wherein the same amounts of quaternary ammonium halide (as in the complexes in the emulsions) are employed in commercial detergent compositions or are separately added to the wash water, significant decreases in the soil removal indices are noted. Similarly, even when the cationic/anionic complex is made and is added to the wash water, but as the complex alone, not in the microemulsion of this invention, objectionable greasy spotting of the laundry is noted, which does not occur in Experiments A-E of Example 3.

Results like those reported above are also obtained when there are substituted for the above emulsions of this invention those additional emulsion variations described in Example 2. Similarly, when other emulsifiers are employed, such as those previously mentioned in Example 2 which yield stable microemulsions, similar desirable results are obtainable.

EXAMPLE 4 (Experimental Variations)

When the proportions of the components of the emulsions of the previous examples, the proportions of the components of the detergent compositions, the concentrations of the detergent compositions and emulsions in the wash water, and the molar proportions of cationic and anionic surfactants to form the complex are varied ±10%, ±20%, and ±30% in the experiments previously reported, while being kept within the ranges given in the specification, similar good results for the invented emulsions are obtainable. Such is also the case when the temperatures and concentrations are similarly varied but maintained within the ranges specified.

The invention has been described in conjunction with descriptions, illustrations and working examples thereof but it is not to be limited to these because it is evident that one of skill in the art, with the present specification before him, will be able to utilize substitutes and equivalents without departing from the invention.

What is claimed is:

1. A process for manufacturing the microemulsion, an aqueous emulsion of a complex of a cationic surfactant and an anionic surfactant which comprises mixing together the cationic and anionic surfactants in molar proportions in the range of about 1:1 to 1:1.5, respectively, heating such mixture, with continued mixing, until it melts, and becomes clear, and cooling such melt to a temperature at which it solidifies as a complex, mixing about ten parts by weight of such complex and 0.5 to 10 parts of emulsifying agent, heating such mixture, with stirring, to a temperature at which the mixture is liquid, adding aqueous medium slowly to the heated liquid while maintaining its temperature and continuing stirring, until the mixture passes through its inversion point, continuing addition of aqueous medium, with stirring until 15 to 100 parts of aqueous medium have been added.

2. A process according to claim 1 wherein the cationic surfactant is a quaternary ammonium salt or an imidazolinium salt or a mixture thereof, the anionic surfactant is a sulfonate, a sulfate or a carboxylate, or a mixture thereof, and the proportions of emulsifying agent and aqueous medium are 1 to 5 parts and 15 to 50 parts, respectively.

3. A process according to claim 2 wherein the cationic surfactant is di-hydrogenated tallowalkyl dimethyl ammonium chloride, the anionic surfactant is sodium linear tridecylbenzene sulfonate, the molar proportion of such surfactants is about 1:1, the heating of the surfactants is to a temperature in the range of 105° to200° C., and the cooling thereafter is to room temperature, 1.1 to 4.4 parts of emulsifying agent are employed, which emulsifying agent is a mixture of emulsifiers, such emulsifiers being ethoxylated higher fatty alcohol, which is a condensation product of a mole of higher fatty alcohol of an average of 12 to 15 carbon atoms, with about 7 moles of ethylene oxide, and ethoxylated mono-tallowalkyl amine of 5 to 40 moles of ethylene oxide per mole, the mixture of surfactant complex and emulsifying agent is heated to a temperature in the range of 75° to 95° C., the aqueous medium is water, and 20 to 35 parts thereof are added to the surfactant complex-emulsifying agent mixture to form an antistatic and fabric softening oil-in-water microemulsion.

4. A process for simultaneously washing laundry and treating it to soften it and make it antistatic, which comprises washing the laundry in wash water at a temperature in the range of 30° to 95° C. with a built synthetic anionic organic detergent composition which includes 5 to 35% of synthetic anionic organic detergent, 10 to 80% of builder for such anionic detergent and 0 to 50% of filler salt, which detergent composition is present in the wash water at a concentration in the range of 0.05 to 0.5%, in the presence of 0.02 to 0.2% of the antistatic and fabric softening microemulsion of a complex of a cationic surfactant and an anionic surfactant, in which the molar proportions of cationic and anionic moieties are in the range of about 1:1 to 1:1.5, which emulsion comprises about ten parts by weight of such complex, 0.5 to 10 parts by weight of emulsifying agent and 15 to 100 parts by weight of aqueous medium in an wash water, wherein the ratio of aqueous microemulsion to detergent composition is in the range of 1:10 to 1:1, rinsing the washed laundry, and drying it.

5. A process according to claim 4 wherein the wash water is in an automatic washing machine and its temperature is in the range of 30° to 60° C., the synthetic anionic organic detergent of the detergent composition is selected from the group consisting of higher fatty alcohol sulfates, higher alkylbenzene sulfonates, sulfated ethoxylated higher fatty alcohols, olefin sulfonates, paraffin sulfonates, monoglyceride sulfates, and mixtures thereof, the builder is selected from the group consisting of polyphosphates, carbonates, bicarbonates, borates, silicates, zeolites, and mixtures thereof, and the filler salt is sodium sulfate, the antistatic and fabric softening microemulsion is comprised of a complex of a cationic surfactant which is a quaternary ammonium salt or an imidazolinium salt or a mixture thereof and an anionic surfactant, which is a sulfonate, sulfate or a carboxylate, or a mixture thereof, an emulsifying agent which is an ethoxylated higher alkyl amine, an ethoxylated higher alcohol or an ethoxylated higher alkyl amine/higher fatty acid complex, or a mixture thereof, and aqueous medium, in which the aqueous medium is water, with the proportions of complex emulsifying agent and water being 10 parts, 1 to 5 parts and 15 to 50 parts, respectively.

6. A process according to claim 5 wherein the temperature of the wash water is in the range of 35° to 50° C., the synthetic anionic organic detergent of the detergent composition is sodium linear higher alkyl benzene sulfonate, sodium higher fatty alcohol sulfate, sodium higher fatty alcohol ethoxylate sulfate, or a mixture thereof, the builder is sodium tripolyphosphate, sodium pyrophosphate, sodium carbonate, sodium bicarbonate, sodium silicate, sodium borate, or a mixture thereof, the proportions of synthetic anionic organic detergent, builder and filler salt are in the ranges of 15 to 30%, 25 to 70%, and 0 to 40%, respectively, the antistatic and fabric softening microemulsion is an oil-in-water microemulsion and is comprised of a complex of about equimolar proportions of a quaternary ammonium salt cationic surfactant and a higher alkylbenzene sulfonate anionic surfactant detergent, an emulsifying agent which is an ethoxylated higher fatty alcohol which is a condensation product of a mole of higher fatty alcohol of an average of 12 to 15 carbon atoms, with about 7 moles of ethylene oxide, or an ethoxylated monotallowalkyl amine of 5 to 40 moles of ethylene oxide per mole, or a mixture thereof, and water.

7. A process according to claim 6 wherein the microemulsion comprises 10 parts of the surfactant complex, 1.1 to 4.4 parts of a mixture of emulsifiers, such emulsifiers being ethoxylated higher fatty alcohol which is a condensation product of a mole of higher fatty alcohol of an average of 12 to 15 carbon atoms, with about 7 moles of ethylene oxide, and ethoxylated monotallowalkyl amine of 5 to 40 moles of ethylene oxide per mole, in a ratio of 1:1 to 5:1, by weight, and 20 to 35 parts of water, and the concentrations of detergent composition and microemulsion in the wash water are in the ranges of 0.1 to 0.3% and 0.03 to 0.1%, respectively.

* * * * *